US006406376B1

(12) United States Patent
Lin

(10) Patent No.: US 6,406,376 B1
(45) Date of Patent: Jun. 18, 2002

(54) COMPOUND SCREW DRIVE RECESSES MOLD

(76) Inventor: Chao-Wei Lin, No. 15 Hsin Kuang Village, Kuan Miao Town, Tainan County (TW)

( * ) Notice: Subject to any disclaimer, the term of this patent is extended or adjusted under 35 U.S.C. 154(b) by 0 days.

(21) Appl. No.: 09/580,306

(22) Filed: May 26, 2000

Related U.S. Application Data

(63) Continuation-in-part of application No. 09/373,021, filed on Aug. 11, 1999, now abandoned.

(51) Int. Cl.[7] ..... B21H 3/02

(52) U.S. Cl. ..... 470/63; 470/57; 470/183; 470/184

(58) Field of Search ..... 470/8, 9, 11, 12, 470/16, 57, 58, 60, 63, 183, 184, 191, 205

(56) References Cited

U.S. PATENT DOCUMENTS 3,238,540 A * 3/1966 Muenchinger ..... 470/63
5,358,368 A * 10/1994 Conlan et al. ..... 411/410

* cited by examiner

*Primary Examiner*—Ed Tolan
(74) *Attorney, Agent, or Firm*—Bacon & Thomas

(57) ABSTRACT

A screw drive recess mold for forming screw drive recesses which has a body and a mold base. The mold base consists of four symmetrical fan-shaped protrusions and a center square protrusion. Four elongate rectangular hollow spaces are located in each of the middles between every two neighboring fan-shaped protrusions. A compound screw drive recess formed by this drive recess mold can be driven by various conventional drivers such as of a slot, of a Phillips (cross), of a square, of a cross-square, and of a Pozi. With the tailor made screw driver of this compound drive recess, the drive recess will be able not only to withstand high driving torques but also to securely retain the drive bit (the screw driver) within the recess.

2 Claims, 6 Drawing Sheets

COMPOUND SCREW DRIVE RECESSES MOLD

This invention also relates to screws with compound recesses of continue-in part of Ser. No. 09/373,021 filing date Aug. 11, 1999 which has been abandoned.

BACKGROUND OF THE INVENTION

The present invention relates generally to a drive recess mold to form a drive recess in the screw head top surface, and more particular to form a novel compound drive recess which permits being driven by various types of drive bit such as slot, Phillips (cross), square, Pozi, and cross-square. In addition, the drive recess formed by this invention also can be driven by its tailor-made drive bit (U.S. Pat. Ser. No. 09/373,022) which gives the compound drive recess the capacity to stand efficient high driving torques with minimal drive bit slip or cam-out.

Currently, conventional screws or bolts with a variety of head types-such as countersunk, oval, pan, truss, etc.—can adapt at least five kinds of drive recesses as shown in FIGS. 1, 2, 3, 4 and 5. A in FIG. 1 is of a slot, B in FIG. 2 a cross, C in FIG. 3 a cross-square combination, D in FIG. 4 a square, and E in FIG. 5 a Pozi. Drive recess structures like above mentioned cannot stand comparatively large torques due to the structure weakness and uneven pressure distribution. Loose fit between the drive recess and the drive bit, which are very common in the above mentioned drive recesses, may produce a large torque causing impaired drive recess or broken drive bit.

A U.S. Pat. No. 4,126,908 titled "THREADED FASTENER RECESS FORMING PUNCHCH" has a double cross-shaped recess mold, so the screw formed by it has a recess in its head as shown in FIG. 5, E of a double cross, limiting available screw drive bits (or screw drive driver). U.S. Pat. Nos. 3,898,706, 4,355,552 and 3,238540 have the same structure shown in FIGS. 3 and 5.

SUMMARY OF THE INVENTION

In order to let drive recesses possess the following two features—A) stand comparatively large driving torques with high retention of the drive bit; B) enable to be driven by various types of drive bits-the mold for this compound drive recess is therefor devised.

This compound drive recess formed by the present invention consists of four symmetrical fan-shaped portions, a center square portion and eight chamfer edges intermediate the center square portion and each of the fan-shaped portions. Another version of this compound drive recess consists of all the structures except the eight chamfer edges.

Further objects, features and advantages of the present invention will become apparent from the following detailed description of the invention taken in conjunction with the accompanying drawing wherein like reference numerals designate like elements throughout the several views.

DETAILED DESCRIPTION

Figure 1:
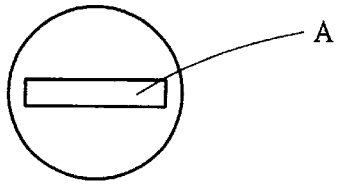
FIG 1 (PRIOR ART)
FIG. 1 is a top view of a conventional slot drive recess.
Figure 2:
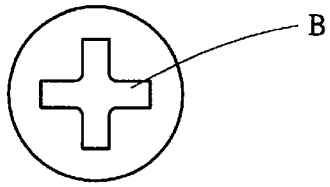
FIG 2 (PRIOR ART)
FIG. 2 is a top view of a conventional Phillips (cross) drive recess.
Figure 3:
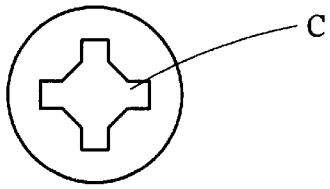
FIG 3 (PRIOR ART)
FIG. 3 is a top view of a conventional cross-square drive recess.
Figure 4:
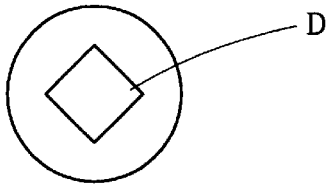
FIG 4 (PRIOR ART)
FIG. 4 is a top view of a conventional square drive recess.
Figure 5:
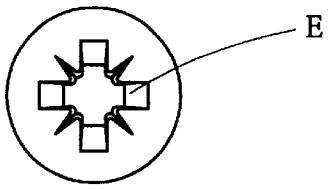
FIG 5 (PRIOR ART)
FIG. 5 is a top view of a conventional Pozi drive recess.
Figure 6:
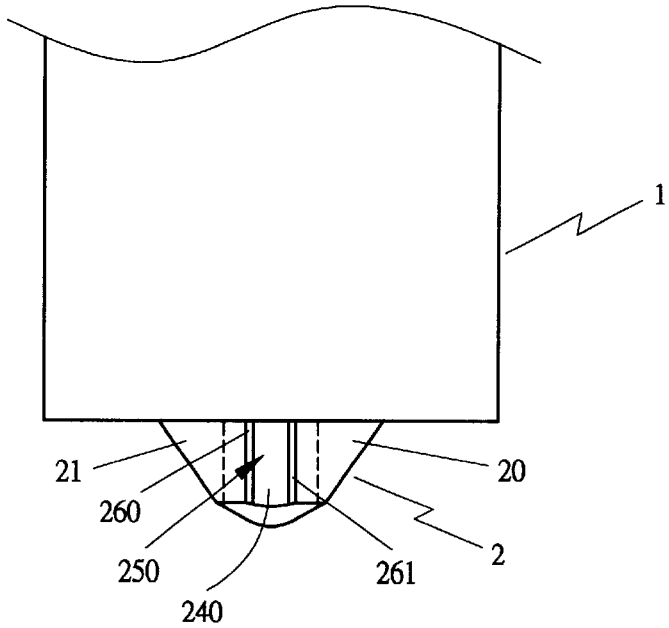
FIG. 6 is a side view of the drive recess mold in the present invention.
Figure 7:
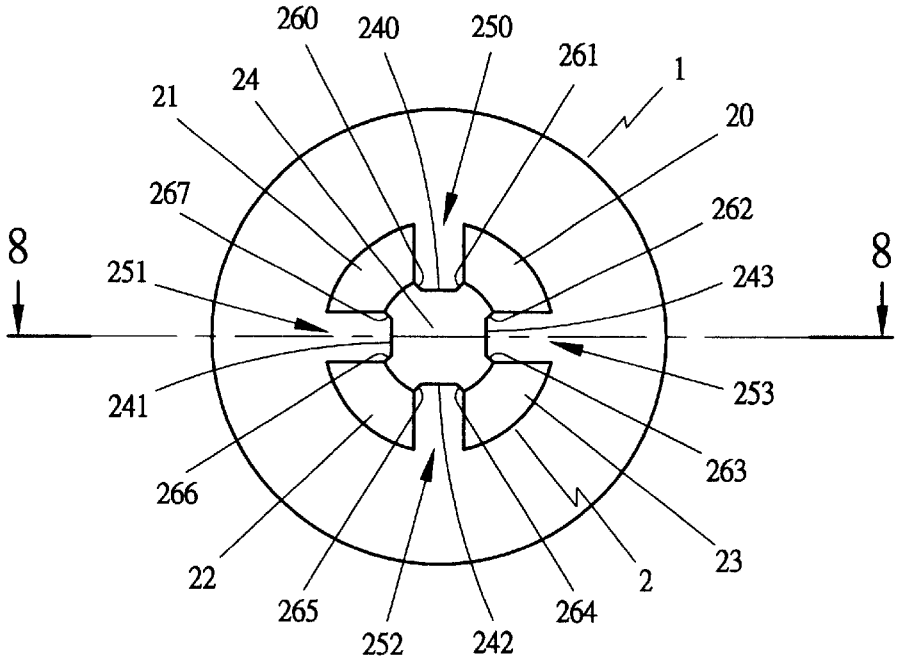
FIG. 7 is a top view of the drive recess mold in the present invention.
Figure 8:
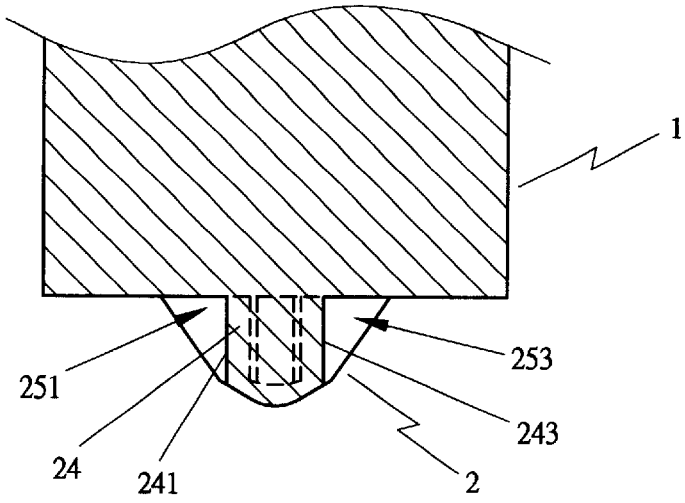
FIG. 8 is a cross-sectional view of the line 8—8 in FIG. 7.
Figure 9:
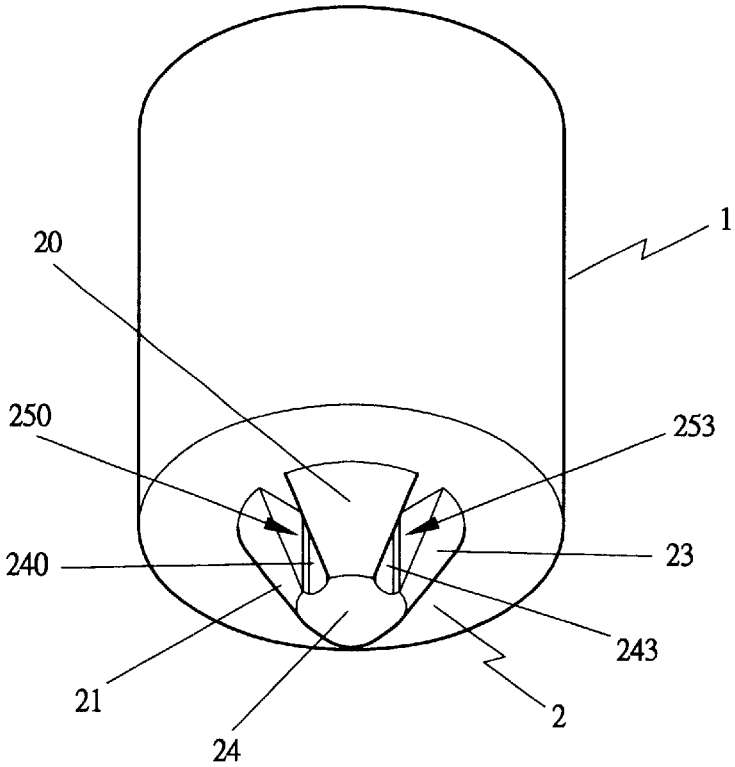
FIG. 9 is a perspective view of the drive recess mold in the present invention.
Figure 12:
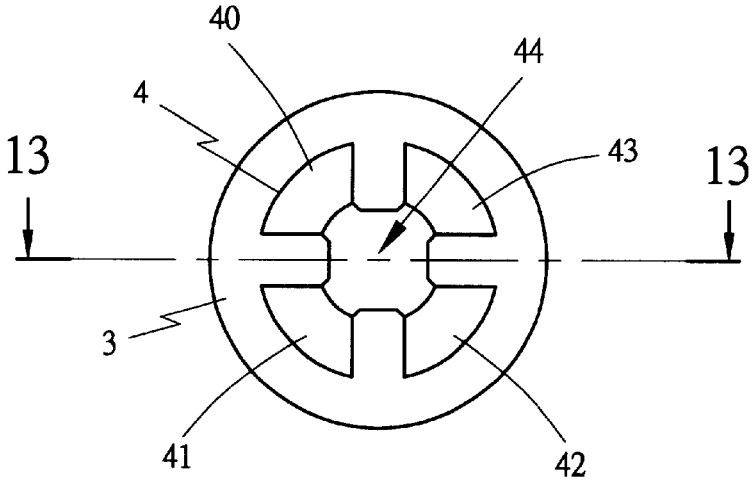
FIG. 12 is a top view of the drive recess mold in the present invention.
Figure 13:
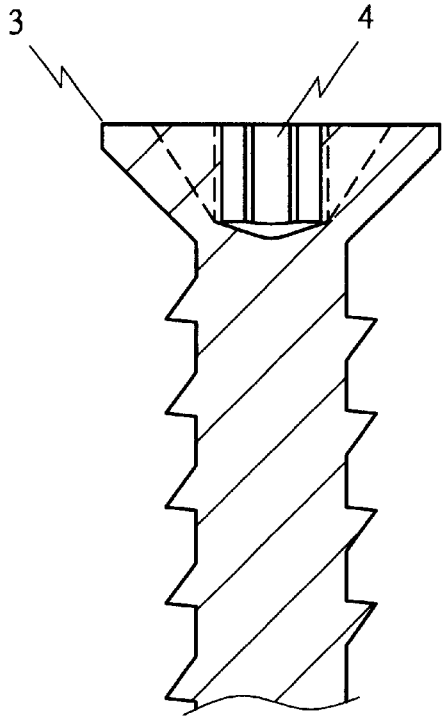
FIG. 13 is a cross-sectional view of the line 13—13 in FIG. 12.
Figure 14:
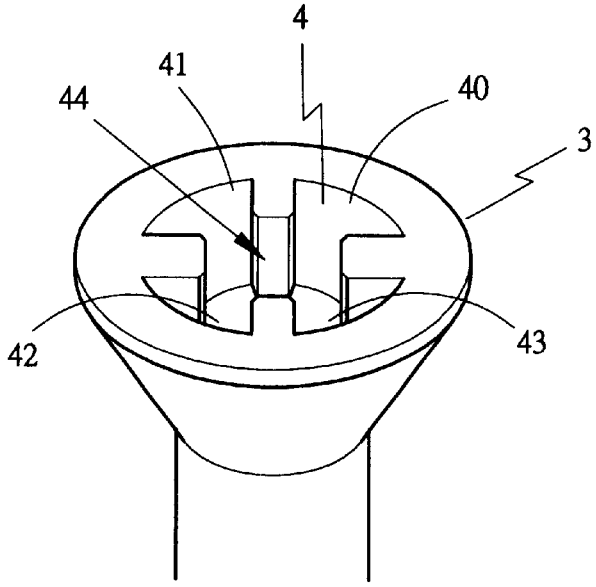
FIG. 14 is a partial perspective view of the compound drive recess in FIG. 12; and, FIG. 15 is partial perspective view of the compound drive recess formed by the no-chamfer-edges drive recess mold in FIG. 10.

Referring now to the drawing, a compound drive recess mold constructed in accordance with the present invention is indicated generally at FIGS. 6, 7, 8 and 9. The mold includes a body 1, and a mold base 2 performing forming process against a screw head to make a compound drive recess 4 as shown in FIGS. 12, 13 and 14. In FIG. 7 a center square protrusion with four vertical surfaces 240, 241, 242, 243 is surrounded by four fan-shaped protrusions 20, 21, 22, 23. Eight chamfer edges 260, 261, 262, 263, 264, 265, 266, 267 are located on the corners intermediate the center square protrusion and each of the four fan-shaped protrusions. Four elongate rectangular hollow spaces 250, 251, 252, 253 are located in the middles between every two neighboring fan-shaped protrusions. Above-mentioned corresponding reference numerals designated elements are also shown in FIGS. 6, 8 and 9. The fan-shaped protrusion" refers to a protrusion having a proximal end with a first side and a distal end with a second side greater than the first side.

Figure 10:
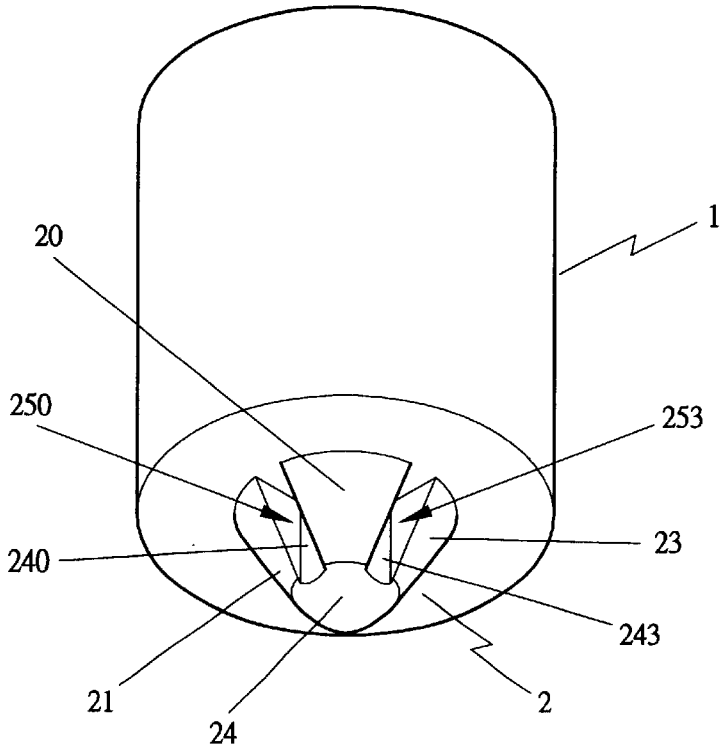
FIG. 10 is a perspective view of the no-chamfer-edges drive recess mold in the present invention.
Figure 11:
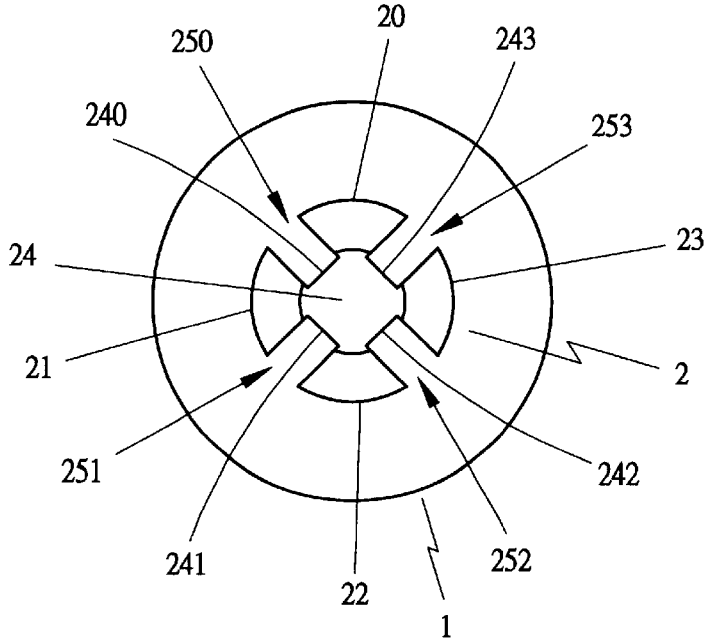
FIG. 11 is a top view of the no-chamfer-edges drive recess mold in the present invention.
Figure 15:
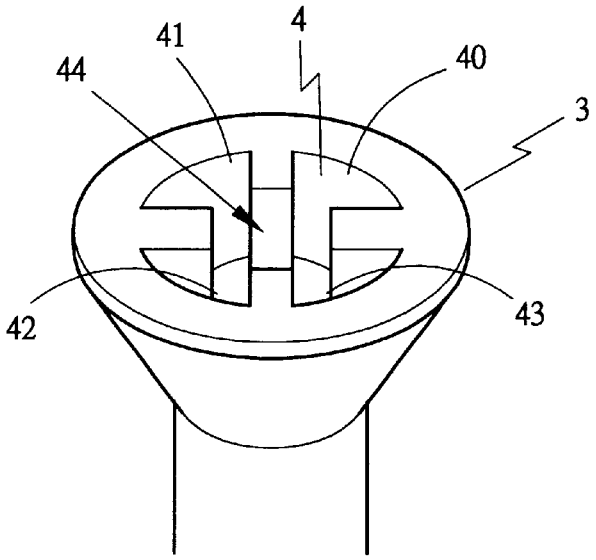

Another no-chamfer-edges version of the drive recess mold is shown in FIGS. 10 and 11. It has the same structure except the eight chamfer edges mentioned in the above paragraph. The drive recess mold with no chamfer edges includes a body 1, and a mold base 2 performing forming process against a screw head to make a compound drive recess 4 as shown in FIG. 15. In FIG. 11 a center square protrusion with four vertical surfaces 240, 241, 242, 243 is surrounded by four fan-shaped protrusions 20, 21, 22, 23. Four elongate rectangular hollow spaces 250, 251, 252, 253 are located respectively in each of the four middles between every two neighboring fan-shaped protrusions. Above-mentioned corresponding reference numerals designated elements are also shown in FIG. 10.

Conventional screw drive force is applied in a circular direction that makes the pressure not evenly applied on the recess pressure-receive surface—the closer to the center the higher pressure. However, the drive bit tailor made for the present invention applies pressure perpendicularly and evenly on the surfaces of the four rectangular projecting bars (which is in the middles between every two neighboring fan-shaped portions as the recess is formed by the present invention), so it not only stands high driving torques but also helps the drive bit to retain in the drive recess.

While the invention has been described above, it will be recognized and understood that various modifications may be made therein and the appended claims are intended to cover all such modifications which may fall within the spirit and scope of the invention.

What is claimed is:

1. A screw mold for forming recesses on a screw head comprising:

a body portion having a base;

a center square protrusion extending from the base of the body portion, said center square protrusion having four vertical walls and four corners; and four fan-shaped protrusions radially extending from each corner of the center square protrusion, each of the four fan-shaped protrusions having a proximal end with a first side and a distal end with a second side greater than the first side.

2. The screw mold as claimed in claim 1, further comprising eight chamfers each disposed between the vertical wall and the fan-shaped protrusion.

* * * * *